US010679840B2

(12) United States Patent
Bajic et al.

(10) Patent No.: US 10,679,840 B2
(45) **Date of Patent: *Jun. 9, 2020**

(54) MINIATURE ION SOURCE OF FIXED GEOMETRY

(71) Applicant: Micromass UK Limited, Wilmslow, Cheshire (GB)

(72) Inventors: Stevan Bajic, Sale (GB); David Gordon, Middlewich (GB); Daniel James Kenny, Knutsford (GB); Richard Barrington Moulds, Stockport (GB); Stephen O'Brien, Manchester (GB); Ian Trivett, Cheadle (GB); Kate Whyatt, Cheshire (GB)

(73) Assignee: Micromass UK LImited, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/256,687

(22) Filed: Jan. 24, 2019

(65) Prior Publication Data

US 2019/0244800 A1 Aug. 8, 2019

Related U.S. Application Data

(63) Continuation of application No. 15/022,396, filed as application No. PCT/GB2014/052819 on Sep. 17, 2014, now Pat. No. 10,236,171.

(30) Foreign Application Priority Data

Sep. 20, 2013 (EP) ..... 13185443
Sep. 20, 2013 (GB) ..... 1316772.1
Sep. 20, 2013 (GB) ..... 1316782.0

(51) Int. Cl.
*H01J 49/16* (2006.01)
*H01J 49/00* (2006.01)
*H01J 49/04* (2006.01)

(52) U.S. Cl.
CPC ..... *H01J 49/167* (2013.01); *H01J 49/0027* (2013.01); *H01J 49/044* (2013.01); *H01J 49/165* (2013.01)

(58) Field of Classification Search
CPC .... H01J 49/0027; H01J 49/044; H01J 49/165; H01J 49/167
See application file for complete search history.

(56) References Cited

U.S. PATENT DOCUMENTS 5,668,370 A * 9/1997 Yano ..... H01J 49/107 250/285
5,756,996 A 5/1998 Bier et al.
(Continued)

FOREIGN PATENT DOCUMENTS

WO 2010/090957 A2 8/2010

OTHER PUBLICATIONS

Kruve et al. "Optimization of electrospray interface and quadropole ion trap mass spectrometer parameters in pesticide liquid chromatography/electrospray ionization mass spectrometry analysis." Rapid Comm. Mass Spectrometry. 24.7 (2012): 919-926.

*Primary Examiner* — Wyatt A Stoffa
(74) *Attorney, Agent, or Firm* — Womble Bond Dickinson (US) LLP; Deborah M. Vernon; Heath T. Misley

(57) ABSTRACT

A mass spectrometer is disclosed comprising an atmospheric pressure interface comprising a gas cone 6 having an inlet aperture, wherein the gas cone 6 has a first longitudinal axis arranged along an x-axis and an Electrospray ion source comprising a first capillary tube 2 having an outlet and
(Continued)

having a second longitudinal axis and a second capillary tube 3 which surrounds the first capillary tube 2. The mass spectrometer further comprises a desolvation gas supply tube and a first device arranged and adapted to supply an analyte liquid via the first capillary tube 2 so that the liquid exits the outlet of the first capillary tube 2 at a flow rate >200 μL/min. The mass spectrometer further comprises a second device arranged and adapted to supply a nebuliser gas via the second capillary tube 3 at a flow rate in the range 80-150 L/hr, wherein an outlet of the first capillary tube 2 is arranged at a distance x mm along the x-axis as measured from the centre of the gas cone inlet aperture, a distance y mm along a y-axis as measured from the centre of the gas cone inlet aperture and a distance z mm along a z-axis as measured from the centre of the gas cone inlet aperture. The x-axis, the y-axis and the z-axis are mutually orthogonal. The desolvation gas supply tube surrounds the second capillary tube 3 and the mass spectrometer further comprises a third device arranged and adapted to supply a desolvation gas via the desolvation gas supply tube at a flow rate in the range 400-1200 L/hr, a heater 4 arranged and adapted to heat the desolvation gas to a temperature ≥100° C. and a fourth device arranged and adapted to supply a cone gas to the gas cone 6 at a flow rate in the range 40-80 L/hr and wherein x is in the range 2.0-5.0 mm and wherein the ratio z/x is in the range 1-5:1.

17 Claims, 10 Drawing Sheets

(56) References Cited

U.S. PATENT DOCUMENTS 6,759,650 B2 7/2004 Covey et al.
7,115,862 B2 * 10/2006 Nagai ..... H01J 49/0009 250/292
7,265,362 B2 9/2007 Bajic et al.
7,294,841 B2 11/2007 Bajic et al.
7,381,948 B2 * 6/2008 Nagai ..... H01J 49/0009 250/252.1
7,667,197 B2 * 2/2010 Lin ..... H01J 49/12 250/281
7,671,329 B2 * 3/2010 Sakata ..... H01J 49/105 250/281
8,026,478 B2 9/2011 Bajic
8,035,088 B2 10/2011 Tomany et al.
8,039,795 B2 10/2011 Mordehai et al.
8,471,200 B2 6/2013 Campuzano et al.
8,502,140 B2 8/2013 Whitehouse et al.
8,598,522 B2 12/2013 Tomany et al.
10,236,171 B2 * 3/2019 Bajic ..... H01J 49/165
2002/0043624 A1 * 4/2002 Hindsgaul ..... G01N 30/7266 250/423 R
2002/0096631 A1 * 7/2002 Andrien, Jr. ..... H01J 49/0009 250/288
2003/0092195 A1 * 5/2003 Moon ..... G01N 30/6095 436/173
2003/0189170 A1 * 10/2003 Covey ..... H01J 49/049 250/288
2004/0079881 A1 * 4/2004 Fischer ..... H01J 49/0445 250/288
2005/0139763 A1 * 6/2005 Nagai ..... H01J 49/0009 250/287
2005/0269518 A1 * 12/2005 Bajic ..... H01J 49/044 250/423 F
2008/0083873 A1 * 4/2008 Giardina ..... H01J 49/165 250/283
2009/0008569 A1 * 1/2009 Balogh ..... H01J 49/145 250/424
2009/0242749 A1 * 10/2009 Bajic ..... H01J 49/04 250/282
2010/0301207 A1 12/2010 Howes et al.
2011/0127416 A1 * 6/2011 Campuzano ..... H01J 49/0431 250/282
2011/0215237 A1 * 9/2011 Bateman ..... H01J 49/0031 250/282
2012/0138790 A1 6/2012 Wright et al.
2013/0319862 A1 * 12/2013 Kotowski ..... H01J 49/022 204/452
2014/0014747 A1 * 1/2014 Moeller ..... H01J 49/10 239/690
2014/0291544 A1 * 10/2014 Hardman ..... H01J 49/165 250/423 R
2015/0308987 A1 * 10/2015 Vukovic ..... G01N 30/34 436/8
2016/0181082 A1 * 6/2016 Covey ..... H01J 49/165 250/424

* cited by examiner

MINIATURE ION SOURCE OF FIXED GEOMETRY

CROSS-REFERENCE TO RELATED APPLICATION

This application is a continuation of U.S. patent application Ser. No. 15/022,396 filed Mar. 16, 2016, which is the National Stage of International Application No. PCT/GB2014/052819 filed Sep. 17, 2014, which claims priority from and the benefit of United Kingdom Application No. 1316772.1 filed Sep. 20, 2013, United Kingdom Application No. 1316782.0 filed Sep. 20, 2013, and European Application No. 13185443.2 filed on Sep. 20, 2013. The entire contents of these applications are incorporated herein by reference.

BACKGROUND TO THE PRESENT INVENTION

The present invention relates to an atmospheric pressure interface and an ion source for a mass spectrometer. According to the preferred embodiment the atmospheric pressure interface and ion source form part of a miniature mass spectrometer.

A known miniature mass spectrometer is disclosed in FIG. 9 of US 2012/0138790 (Microsaic) and Rapid Commun. Mass Spectrom. 2011, 25, 3281-3288. The miniature mass spectrometer as shown in FIG. 9 of US 2012/0138790 comprises a three stage vacuum system. The first vacuum chamber comprises a vacuum interface. No RF ion guide is located within the vacuum interface and the vacuum interface is maintained at a relatively high pressure of >67 mbar (>50 Torr). A small first diaphragm vacuum pump is used to pump the vacuum interface.

The second vacuum chamber contains a short RF ion guide which is operated at a pressure-path length in the range 0.01-0.02 Torr·cm and is vacuum pumped by a first turbomolecular vacuum pump which is backed by a second diaphragm vacuum pump. The second separate diaphragm vacuum pump is required due to the relative high pressure (>67 mbar) of the first vacuum chamber. The high pressure in the first vacuum chamber effectively prevents the same diaphragm vacuum pump from being used to back both the first turbomolecular vacuum pump and also to pump the first vacuum chamber due to the fact that turbomolecular vacuum pumps are generally only able to operate with backing pressures of <20 mbar.

The known miniature mass spectrometer is used in conjunction with a microspray ion source wherein a nebulising gas is supplied at a rate of 2.5 L/min and the liquid flow rate to the emitter tip is 0.3-0.8 μL/min.

Known Electrospray ion sources as used with conventional full size mass spectrometers have many degrees of freedom which allows the ion source to be tuned or optimised for a variety of different compounds and circumstances.

Conventional full size Electrospray ion sources also typically have substantially higher liquid flow rates of several mL/min and the nebuliser may be surrounded by a heater which supplies a flow of heated desolvation gas in addition to the nebulisation gas emitted from the nebuliser.

Conventional full size Electrospray ion sources are complex and have many degrees of freedom which can make it difficult for an unskilled or inexperienced user of a mass spectrometer to interact with and operate both the ion source and the mass spectrometer.

US 2003/0189170 (Covey) discloses an arrangement comprising a nebuliser source probe 72 as shown in FIG. 3 of US 2003/0189170 (Covey). The probe comprises a central capillary tube and an annular chamber around the capillary tube for providing an annular flow of gas around the capillary tube as discussed at paragraph [0079]. The central capillary tube is not shown in FIG. 3. Although a heater 71 is shown surrounding the nebuliser probe 72, as detailed at paragraph [0080] the heater 71 is not used when the ion source comprises a nebuliser. Instead, the heater 71 just functions as a holder or receptacle. FIG. 7 of US 2003/0189170 (Covey) shows two gas sources 110 which are arranged either side of the ion source 70 and which produce gas jets 104 that impinge upon the expanding spray cone 106 from the ion source 70 as discussed at paragraph [0093].

GB-2446960 (Micromass) discloses using sulphur hexafluoride as a cone or curtain gas.

GB-2437819 (Micromass) discloses an ionisation source wherein one or more wires are provided within a capillary tube forming the ionisation source.

It is desired to provide an improved mass spectrometer and method of mass spectrometry.

SUMMARY OF THE PRESENT INVENTION

According to an aspect of the present invention there is provided a mass spectrometer comprising:

an atmospheric pressure interface comprising a gas cone having an inlet aperture, wherein the gas cone has a first longitudinal axis arranged along an x-axis;

an Electrospray ion source comprising a first capillary tube having an outlet and having a second longitudinal axis and a second capillary tube which surrounds the first capillary tube;

a desolvation gas supply tube;

a first device arranged and adapted to supply an analyte liquid via the first capillary tube so that the liquid exits the outlet of the first capillary tube at a flow rate >200 μL/min; and a second device arranged and adapted to supply a nebuliser gas via the second capillary tube at a flow rate in the range 80-150 L/hr;

wherein an outlet of the first capillary tube is arranged at a distance x mm along the x-axis as measured from the centre of the gas cone inlet aperture, a distance y mm along a y-axis as measured from the centre of the gas cone inlet aperture and a distance z mm along a z-axis as measured from the centre of the gas cone inlet aperture;

wherein the x-axis, the y-axis and the z-axis are mutually orthogonal;

wherein the desolvation gas supply tube surrounds the second capillary tube;

and wherein the mass spectrometer further comprises:

a third device arranged and adapted to supply a desolvation gas via the desolvation gas supply tube at a flow rate in the range 400-1200 L/hr;

a heater arranged and adapted to heat the desolvation gas to a temperature 100° C.; and a fourth device arranged and adapted to supply a cone gas to the gas cone at a flow rate in the range 40-80 L/hr;

wherein x is in the range 2.0-5.0 mm and wherein the ratio z/x is in the range 1-5:1.

The preferred ion source preferably comprises a fixed ion source for a miniature mass spectrometer. According to the preferred embodiment the orientation of the Electrospray ion source relative to the atmospheric pressure interface is fixed such that a user can not adjust the orientation.

It will be understood that the ion source according to the present invention as preferably utilised with a miniature mass spectrometer is substantially different from the known miniature mass spectrometer arrangement.

In contrast to the known arrangement heated desolvation gas is supplied around the inner liquid and outer nebulising capillaries. Furthermore, the desolvation gas is also supplied at a significantly higher gas flow rate (400-1200 L/Hr) than conventional full size known arrangements.

Liquid is also supplied to and exits from the inner liquid capillary tube at substantially higher flow rates (>200 μL/min) than the known miniature microspray ion source (0.3-0.8 μL/min).

Furthermore, the nebulising gas is supplied to the nebuliser capillary tube at a relatively narrow gas flow range of 80-150 L/hr and the cone gas is similarly supplied to the gas cone within a relatively narrow gas flow range of 40-80 L/hr.

Another aspect of the present invention is that the ratio z/x, namely the probe height (z) to the probe x offset (x) is in the range 1-5:1.

US 2003/0189170 (Covey) discloses an arrangement comprising a nebuliser source probe 72 as shown in FIG. 3 of US 2003/0189170 (Covey) and comprises a central capillary tube and an annular chamber around the capillary tube for providing an annular flow of gas around the capillary tube as discussed at paragraph [0079]. The central capillary tube is not shown in FIG. 3. Although a heater 71 is shown surrounding the nebuliser probe 72, paragraph [0080] makes it clear that the heater 71 is not used when the ion source comprises a nebuliser. Instead, the heater 71 just functions as a holder or receptacle.

FIG. 7 of US 2003/0189170 (Covey) shows two gas sources 110 arranged either side of the ion source 70 and which produce gas jets 104 that impinge upon the expanding spray cone 106 from the ion source 70 as discussed in paragraph [0093].

The gas heaters are shown and described in more detail with reference to FIGS. 10a-10d of US 2003/0189170 (Covey).

US 2003/0189170 (Covey) does not disclose providing a desolvation gas supply tube which surrounds the second capillary tube or providing a third device arranged and adapted to supply a desolvation gas via the desolvation gas supply tube at a flow rate in the range 400-1200 L/hr. Instead of a tri-axial arrangement according to the present invention, US 2003/0189170 (Covey) discloses supplying desolvation gas via separate heaters 110 which do not surround the second capillary tube. Furthermore, the flow rates detailed in paragraph [0115] relate to a prior commercial APCI probe and the flow rates detailed in paragraph [0116] relate to a prior nebuliser source and not the arrangement shown and described in relation to FIG. 3 or 7 of US 2003/0189170 (Covey).

It will be appreciated that the desolvation flow rate of 400-1200 L/hr according to the present invention is significantly higher than conventional full size known arrangements.

US 2003/0189170 (Covey) also does not disclose providing a fourth device arranged and adapted to supply a cone gas to the gas cone at a flow rate in the range 40-80 L/hr. Furthermore, US 2003/0189170 (Covey) does not disclose limiting x to be in the range 2.0-5.0 mm or setting the ratio z/x to be in the range 1-5:1.

The combination of the specific flow rates of the present invention and the specific geometrical orientation of the ion source relative to the gas cone which are the subject of the present invention has been found to provide a synergistic effect and to provide optimal performance.

In particular, the ion source according to the present invention by virtue of setting the distance x to be in the range 2.0-5.0 mm has been found not to suffer from the effects of either being non-robust ion source (due to the spray emitted from the probe impinging upon the gas cone if x<2.0 mm) or to suffer loss of signal (if x>5.0 mm). Furthermore, the ion source according to the present invention does not suffer from loss of signal due to the formation of gaseous ammonia or the presence of buffer compounds when operated within the ranges according to the present invention.

It has been found that the optimum position for the probe is a compromise between maximising the signal intensity (e.g. by ensuring that x≤5.0 mm) whilst minimising the amount of spray directly impinging near the sampling orifice (e.g. by ensuring that x≥2.0 mm).

Accordingly, it is a feature of the present invention that the distance x is maintained within the range 2.0-5.0 mm which in combination with an analyte liquid flow rate of >200 μL/min, a desolvation gas flow rate in the range 400-1200 L/hr, a cone gas flow rate in the range 40-80 L/Hr, a nebuliser gas flow rate in the range 80-150 L/Hr and maintaining the ratio z/x in the range 1-5:1 has been found to be particularly advantageous.

According to the preferred embodiment of the present invention the atmospheric pressure interface is arranged such that the analyte liquid flow rate is fixed >200 μL/min, the distance x is fixed at a distance between 2.0-5.0 mm, the desolvation gas flow rate is fixed in the range 400-1200 L/hr, the cone gas flow rate is fixed in the range of 40-80 L/Hr, the nebuliser gas flow rate is fixed the range 80-150 L/Hr and the ratio z/x is fixed in the range 1-5:1 such that a user (who may be an inexperienced user of a mass spectrometer) is unable to adjust the orientation and/or flow rates. As a result, an inexperienced user does not have to concern themselves with adjusting the ion source and gas flow rates in order to maximise sensitivity which can be a complex and skilled task.

The present invention therefore enables a mass spectrometer to be used in an optimum manner and with optimum sensitivity by an inexperienced user. As a result, the mass spectrometer according to the present invention is particularly advantageous compared with a conventional mass spectrometer.

The ion source according to the present invention is therefore particularly advantageous compared to the known microspray ion source and also compared to conventional full size Electrospray ion sources and arrangements such as those disclosed in US 2003/0189170 (Covey).

According to the preferred embodiment the orientation of the Electrospray ion source relative to the atmospheric pressure interface is fixed such that a user can not adjust the orientation.

According to the preferred embodiment the analyte liquid flow rate is fixed such that a user can not adjust the flow rate.

According to the preferred embodiment the nebuliser gas flow rate is fixed such that a user can not adjust the flow rate.

According to the preferred embodiment the desolvation gas flow rate is fixed such that a user can not adjust the flow rate.

According to the preferred embodiment the cone gas flow rate is fixed such that a user can not adjust the flow rate.

According to the preferred embodiment the orientation of the Electrospray ion source relative to the atmospheric pressure interface is fixed such that a user can not adjust the orientation and also the analyte liquid flow rate, the nebuliser gas flow rate, the desolvation gas flow rate and the cone gas flow rate are all fixed such that a user can not adjust the flow rates.

According to an embodiment x falls within a range selected from the group consisting of: (i) 2-3 mm; (ii) 3-4 mm; (iii) 4-5 mm; (iv) 2.0-5.0 mm; (v) 2.5-4.5 mm; and (vi) 3.0-4.0 mm.

According to a particularly preferred embodiment the ratio z/x is in the range 2.0-3.5:1, further preferably 2.5-3.0:1.

According to a particularly preferred embodiment the probe offset x is set at 3.5 mm, the probe height z is set at 9.0 mm giving a ratio z/x of 2.57, the liquid flow rate is set at 0.2 to 2 mL/min and the cone gas flow rate is set at 40-80 L/Hr.

According to the preferred embodiment x is in the range 2.0-5.0 mm, preferably 2.5-4.5 mm, further preferably 3.0-4.0 mm. This precise location has been found to be particularly advantageous in that the ion source when operated at such a position does not suffer from the deleterious effects of gaseous ammonia or ionisation suppression effects due to buffer compounds.

According to the preferred embodiment y falls within a range selected from the group consisting of: (i) 0.0-1.0 mm; (ii) 1.0-2.0 mm; (iii) 2.0-3.0 mm; (iv) 3.0-4.0 mm; and (v) 4.0-5.0 mm. This precise location has been found to be particularly advantageous in that the ion source when operated at such a position does not suffer from the deleterious effects of gaseous ammonia or ionisation suppression effects due to buffer compounds.

According to another embodiment y may be in the range 8.0-11.0 mm, preferably 8.5-10.5 mm, further preferably 9.0-10.0 mm.

According to the preferred embodiment z falls within a range selected from the group consisting of: (i) 5-6 mm; (ii) 6-7 mm; (iii) 7-8 mm; (iv) 8-9 mm; (v) 9-10 mm; (vi) 10-11 mm; (vii) 11-12 mm; (viii) 12-13 mm; (ix) 13-14 mm; (x) 14-15 mm; (xi) 15-16 mm; (xii) 16-17 mm; (xiii) 17-18 mm; (xiv) 18-19 mm; (xv) 19-20 mm; (xvi) 20-21 mm; (xvii) 21-22 mm; (xviii) 22-23 mm; (xix) 23-24 mm; and (xx) 24-25 mm. This precise location has been found to be particularly advantageous in that the ion source when operated at such a position does not suffer from the deleterious effects of gaseous ammonia or ionisation suppression effects due to buffer compounds.

According to a particularly preferred embodiment the probe x offset (i.e. the distance x) is arranged to be 3.5 mm and the probe height (i.e. the distance z) is arranged to be 9.0 mm. The tip of the inner capillary tube preferably extends 1.2 mm beyond the end of the tube through which the heated desolvation gas is supplied. Furthermore, the capillary supplying the liquid preferably extends 0.5 mm±0.2 mm beyond the end of the nebuliser capillary tube. The liquid flow rate is preferably 0.2 to 2 mL/min and the cone gas flow rate is preferably 40-80 L/Hr.

The first capillary tube preferably protrudes from the second capillary tube by 0.5 mm±0.2 mm.

The first capillary tube preferably protrudes from the desolvation gas supply tube by 1.2 mm±0.2 mm.

The second axis is preferably arranged at an angle α relative to the z-axis, wherein a falls within a range selected from the group consisting of: (i) 0-1°; (ii) 1-2°; (iii) 2-3°; (iv) 3-4°; (v) 4-5°; (vi) 5-6°; (vii) 6-7°; (viii) 7-8°; (ix) 8-9°; (x) 9-10°; (xi) 10-11°; (xii) 11-12°; (xiii) 12-13°; (xiv) 13-14°; and (xv) 14-15°.

The second axis is preferably arranged at an angle β relative to the y-axis, wherein β falls within a range selected from the group consisting of: (i) 0-1°; (ii) 1-2°; (iii) 2-3°; (iv) 3-4°; (v) 4-5°; (vi) 5-6°; (vii) 6-7°; (viii) 7-8°; (ix) 8-9°; (x) 9-10°; (xi) 10-11°; (xii) 11-12°; (xiii) 12-13°; (xiv) 13-14°; and (xv) 14-15°.

The second axis is preferably arranged at an angle γ relative to the y-axis, wherein γ falls within a range selected from the group consisting of: (i) 0-1°; (ii) 1-2°; (iii) 2-3°; (iv) 3-4°; (v) 4-5°; (vi) 5-6°; (vii) 6-7°; (viii) 7-8°; (ix) 8-9°; (x) 9-10°; (xi) 10-11°; (xii) 11-12°; (xiii) 12-13°; (xiv) 13-14°; and (xv) 14-15°.

The first device is preferably arranged and adapted to supply the analyte liquid at a flow rate selected from the group consisting of: (i) 0.2-0.3 mL/min; (ii) 0.3-0.4 mL/min; (iii) 0.4-0.5 mL/min; (iv) 0.5-0.6 mL/min; (v) 0.6-0.7 mL/min; (vi) 0.7-0.8 mL/min; (vii) 0.8-0.9 mL/min; (viii) 0.9-1.0 mL/min; (ix) 1.0-1.1 mL/min; (x) 1.1-1.2 mL/min; (xi) 1.2-1.3 mL/min; (xii) 1.3-1.4 mL/min; (xiii) 1.4-1.5 mL/min; (xiv) 1.5-1.6 mL/min; (xv) 1.6-1.7 mL/min; (xvi) 1.7-1.8 mL/min; (xvii) 1.8-1.9 mL/min; and (xviii) 1.9-2.0 mL/min.

The first device may be arranged and adapted to supply the analyte liquid at a flow rate in the range 1.0-3.0 mL/min. The first device is further preferably arranged and adapted to supply the analyte liquid at a flow rate in the range 1.5-2.5 mL/min. An analyte liquid flow rate of 2.0 mL/min is particularly preferred.

According to the preferred embodiment the third device is arranged and adapted to supply the desolvation gas at a flow rate in the range 400-1200 L/hr, preferably 500-1200 L/hr, further preferably 600-1200 L/hr, further preferably 800-1200 L/hr, further preferably 900-1100 L/hr. According to a particularly preferred embodiment the desolvation gas is supplied at a flow rate of 1000 L/hr.

The heater is preferably arranged and adapted to heat the desolvation gas to a temperature >200° C., preferably >300° C., further preferably >400° C., further preferably >500° C., further preferably in the range 600-700° C. According to a particularly preferred embodiment the heater is arranged to heat the desolvation gas up to a temperature of around 650° C.

The fourth device is preferably arranged and adapted to supply a cone gas to the gas cone at a flow rate in the range 40-80 L/hr, preferably 50-70 L/hr.

According to the preferred embodiment the cone gas and/or the nebuliser gas and/or the desolvation gas comprise nitrogen, sulphur hexafluoride ("SF6"), air or carbon dioxide.

The mass spectrometer preferably comprises a miniature mass spectrometer.

The term "miniature mass spectrometer" should be understood as meaning a mass spectrometer which is physically smaller and lighter than a conventional full size mass spectrometer and which utilises vacuum pumps having lower maximum pumping speeds than a conventional full size mass spectrometer. The term "miniature mass spectrometer" should therefore be understood as comprising a mass spectrometer which utilises a small pump (e.g. with a maximum pumping speed of ≥10 $m^3$/hr) to pump a first vacuum chamber.

According to an aspect of the present invention there is provided a method of mass spectrometry comprising:

providing an atmospheric pressure interface comprising a gas cone having an inlet aperture, wherein the gas cone has a first longitudinal axis arranged along an x-axis;

providing an Electrospray ion source comprising a first capillary tube having an outlet and having a second longitudinal axis and a second capillary tube which surrounds the first capillary tube;

supplying an analyte liquid via the first capillary tube so that the liquid exits the outlet of the first capillary tube at a flow rate >200 μL/min; and supplying a nebuliser gas via the second capillary tube at a flow rate in the range 80-150 L/hr;

wherein an outlet of the first capillary tube is arranged at a distance x mm along the x-axis as measured from the centre of the gas cone inlet aperture, a distance y mm along a y-axis as measured from the centre of the gas cone inlet aperture and a distance z mm along a z-axis as measured from the centre of the gas cone inlet aperture; and wherein the x-axis, the y-axis and the z-axis are mutually orthogonal;

wherein the method further comprises:

providing a desolvation gas supply tube which surrounds the second capillary tube;

supplying a desolvation gas via the desolvation gas supply tube at a flow rate in the range 400-1200 L/hr;

heating the desolvation gas to a temperature 100° C.; and supplying a cone gas to the gas cone at a flow rate in the range 40-80 L/hr;

wherein x is in the range 2.0-5.0 mm and wherein the ratio z/x is in the range 1-5:1.

The present invention relates to a miniature Electrospray ion source which preferably has all of the conventional degrees of freedom removed. The preferred ion source preferably operates at high liquid flow rates of up to 2 mL/min which is more than three orders of magnitude higher than that of the microspray ion source as used with the known miniature mass spectrometer. The ion source according to the present invention is particularly advantageous in that it may be directly coupled to a High Pressure Liquid Chromatography ("HPLC") source and chromatography sources which operate at even higher pressures.

According to the preferred embodiment a fixed ion source is preferably provided which requires little or no user interaction.

The preferred ion source is particularly advantageous in that it allows a miniature mass spectrometer to be utilised by a user who may have no previous experience of operating a mass spectrometer.

The ion source according to the preferred embodiment is essentially a plug and play component which requires no manual set up or previous experience to operate.

Furthermore, various optimal parameters of the ion source and the atmospheric pressure interface of the preferred miniature mass spectrometer have been determined and optimised through experiment and error so that the ion source and associated atmospheric pressure interface according to the preferred embodiment has a high efficiency of ion generation and subsequent transfer of ions into the mass spectrometer for a wide range of analytes.

It will be appreciated that the optimum configuration of the ion source is important to determine since the relative orientation of the ion source and atmospheric pressure interface is fixed and can not be adjusted by a user.

According to an aspect of the present invention there is provided a mass spectrometer comprising:

an atmospheric pressure interface comprising a gas cone having an inlet aperture, wherein the gas cone has a first longitudinal axis arranged along an x-axis;

an Electrospray ion source comprising a first capillary tube having an outlet and having a second longitudinal axis, a second capillary tube which surrounds the first capillary tube and a desolvation gas supply tube which surrounds the second capillary tube;

a first device arranged and adapted to supply an analyte liquid via the first capillary tube so that the liquid exits the outlet of the first capillary tube at a flow rate >100 μL/min, preferably >200 μL/min;

a second device arranged and adapted to supply a nebuliser gas via the second capillary tube at a flow rate in the range 80-150 L/hr;

a third device arranged and adapted to supply a desolvation gas via the desolvation gas supply tube at a flow rate of 200 L/hr;

a heater arranged and adapted to heat the desolvation gas to a temperature ≥100° C.; and a fourth device arranged and adapted to supply a cone gas to the gas cone at a flow rate in the range 40-80 L/hr;

wherein an outlet of the first capillary tube is arranged at a distance x mm along the x-axis as measured from the centre of the gas cone inlet aperture, a distance y mm along a y-axis as measured from the centre of the gas cone inlet aperture and a distance z mm along a z-axis as measured from the centre of the gas cone inlet aperture;

wherein the x-axis, the y-axis and the z-axis are mutually orthogonal; and wherein the ratio z/x is in the range 1-5:1.

According to another aspect of the present invention there is provided a method of mass spectrometry comprising:

providing an atmospheric pressure interface comprising a gas cone having an inlet aperture, wherein the gas cone has a first longitudinal axis arranged along an x-axis;

providing an Electrospray ion source comprising a first capillary tube having an outlet and having a second longitudinal axis, a second capillary tube which surrounds the first capillary tube and a desolvation gas supply tube which surrounds the second capillary tube;

supplying an analyte liquid via the first capillary tube so that the liquid exits the outlet of the first capillary tube at a flow rate >100 μL/min, preferably >200 μL/min;

supplying a nebuliser gas via the second capillary tube at a flow rate in the range 80-150 L/hr;

supplying a desolvation gas via the desolvation gas supply tube at a flow rate of 200 L/hr;

heating the desolvation gas to a temperature 100° C.; and supplying a cone gas to the gas cone at a flow rate in the range 40-80 L/hr;

wherein an outlet of the first capillary tube is arranged at a distance x mm along the x-axis as measured from the centre of the gas cone inlet aperture, a distance y mm along a y-axis as measured from the centre of the gas cone inlet aperture and a distance z mm along a z-axis as measured from the centre of the gas cone inlet aperture;

wherein the x-axis, the y-axis and the z-axis are mutually orthogonal; and wherein the ratio z/x is in the range 1-5:1.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i)<50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i)<100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source.

According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The mass spectrometer may comprise a chromatography detector.

The chromatography detector may comprise a destructive chromatography detector preferably selected from the group consisting of: (i) a Flame Ionization Detector ("FID"); (ii) an aerosol-based detector or Nano Quantity Analyte Detector ("NQAD"); (iii) a Flame Photometric Detector ("FPD"); (iv) an Atomic-Emission Detector ("AED"); (v) a Nitrogen Phosphorus Detector ("NPD"); and (vi) an Evaporative Light Scattering Detector ("ELSD").

Additionally or alternatively, the chromatography detector may comprise a non-destructive chromatography detector preferably selected from the group consisting of: (i) a fixed or variable wavelength UV detector; (ii) a Thermal Conductivity Detector ("TCD"); (iii) a fluorescence detector; (iv) an Electron Capture Detector ("ECD"); (v) a conductivity monitor; (vi) a Photoionization Detector ("PID"); (vii) a Refractive Index Detector ("RID"); (viii) a radio flow detector; and (ix) a chiral detector.

The ion guide is preferably maintained at a pressure selected from the group consisting of: (i)<0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions are preferably caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to a particularly preferred embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments of the present invention together with other arrangements given for illustrative purposes only will now be described, by way of example only, and with reference to the accompanying drawings in which.

DETAILED DESCRIPTION OF PREFERRED EMBODIMENT

Figure 1:
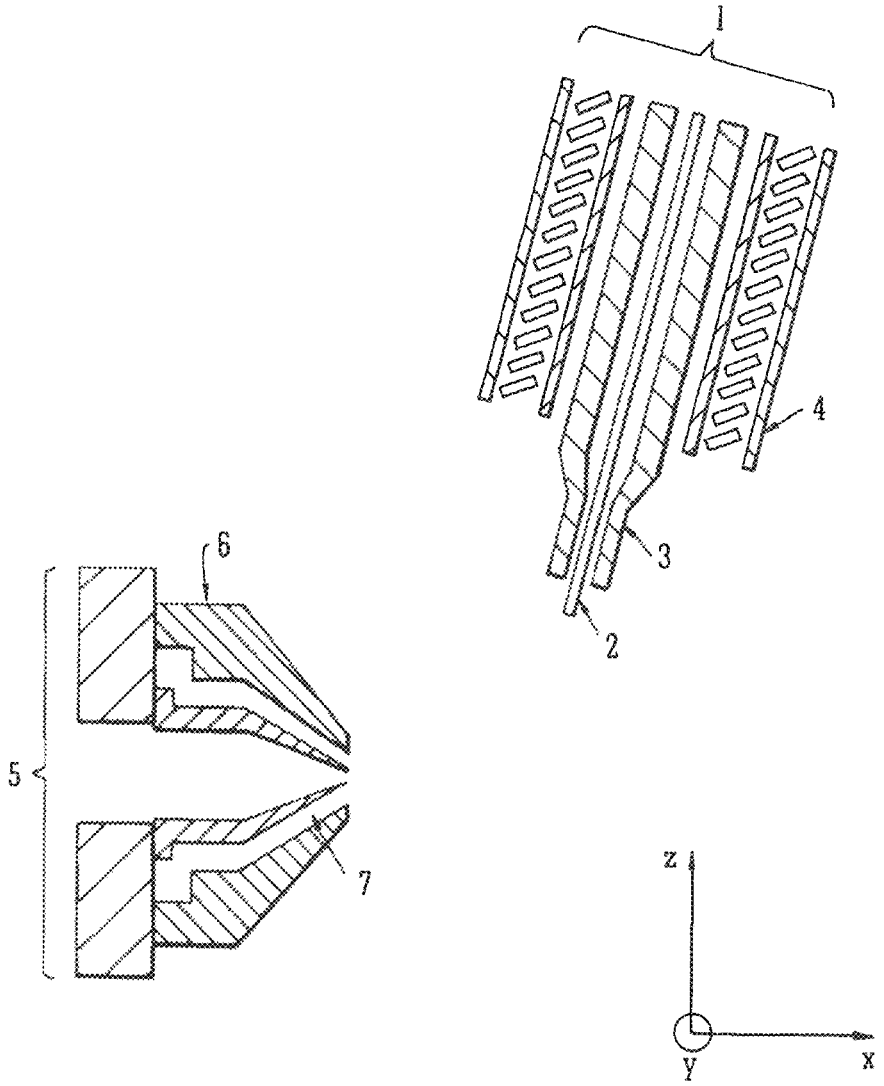
FIG. 1 PRIOR ART
FIG. 1 shows a conventional Electrospray ion source.

A conventional Atmospheric Pressure Ionisation ("API") ion source such as an Electrospray Ionisation ("ESI") ion source or an Atmospheric Pressure Chemical Ionisation ("APCI") ion source as used on commercial known mass spectrometers generally takes the form as shown in FIG. 1.

The ion source comprises an Electrospray probe 1 which comprises an inner capillary tube 2 through which an analyte liquid is supplied. The inner capillary tube 2 is surrounded by a nebuliser capillary tube 3. The emitting end of the inner capillary tube 2 protrudes beyond the nebuliser capillary tube 3. The inner capillary tube 2 and the nebuliser capillary tube 3 are surrounded by a desolvation heater 4 which heats a desolvation gas.

Ions generated by the ion source are directed towards an atmospheric pressure interface comprising an outer gas cone 6 and an inner sample cone 7. A cone gas may be supplied to an annular region between the inner sample cone 7 and the outer gas cone 6.

Conventional ionisation sources are very flexible and can be tuned to obtain optimum sensitivity for a large number of parameters including the flow rate of the liquid exiting the central capillary 2, the constituents of the mobile phase and the compound of interest.

In particular, conventional ion sources have a high number of degrees of freedom. For example, the following parameters can be tuned or altered on a conventional ion source: (i) capillary protrusion; (ii) nebulizer gas flow; (iii) nebulizer protrusion; (iv) desolvation gas flow; (v) desolvation temperature; (vi) cone gas flow; (vii) probe height; (viii) probe offset (x and y); (ix) probe angle (x and y); and (x) capillary voltage.

Figure 2A:
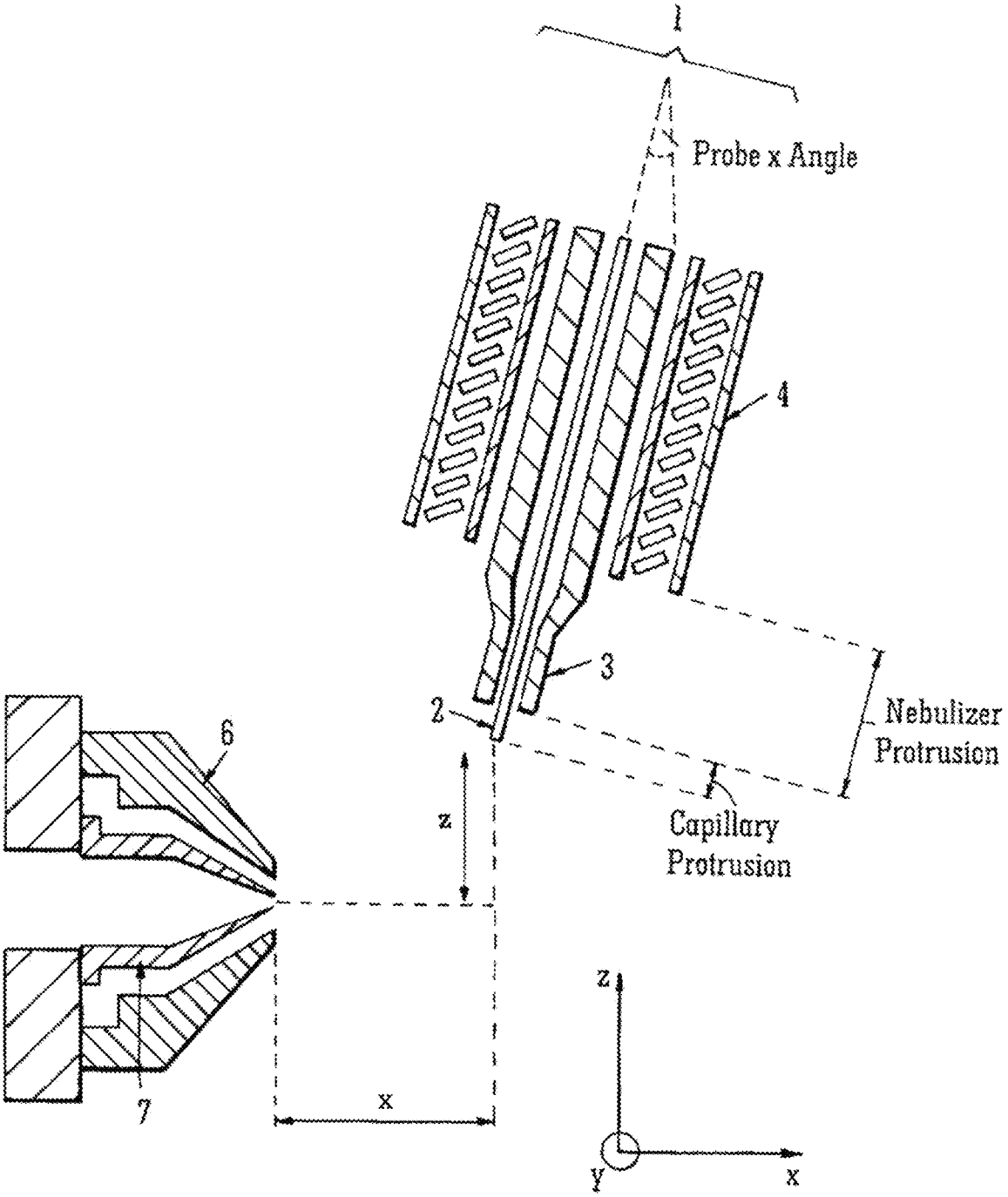
FIG. 2A shows an Electrospray ion source viewed along the y-axis according to an embodiment of the present invention.
Figure 2B:
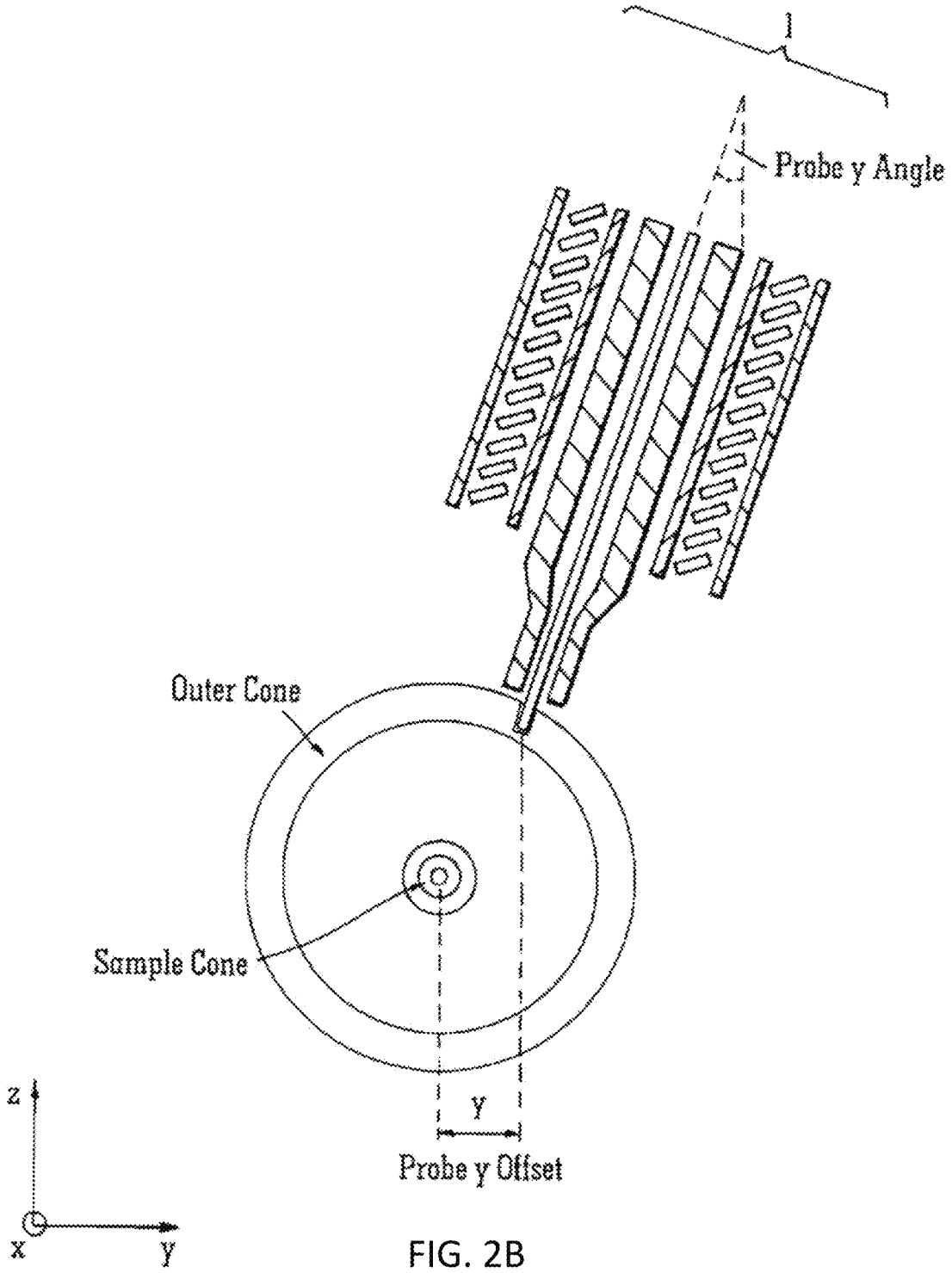
FIG. 2B shows the Electrospray ion source of FIG. 2A viewed along the x-axis according to an embodiment of the present invention.

A preferred embodiment of the present invention will now be described with reference to FIGS. 2A-2B.

According to an embodiment of the present invention an ion source is provided which is intended to be used with a miniature mass spectrometer. Furthermore, preferably all of the degrees of freedom of a conventional ion source have been removed.

According to the preferred embodiment the parameters mentioned above which may be altered by a user in conjunction with a conventional ion source are fixed according to the preferred embodiment and may not be altered by a user.

According to an embodiment only one or two parameters, if any, may be varied or altered by a user by overriding automatic settings in software. These parameters are the capillary voltage and the desolvation temperature.

According to the preferred embodiment all gas flows and all mechanical alignments and orientations are preferably permanently fixed and can not be altered by a user.

According to the preferred embodiment fixed gas flows are obtained by arranging the geometry of the components within the fluid path between the gas source and the particular gas outlet. For example, the nebulizer gas flow may be fixed by an annular restriction between a swaged end of the nebulizer tube 3 and the liquid carrying inner capillary 2.

The desolvation and cone gas flows may be determined by a precision ruby orifice.

Other embodiments are also contemplated wherein a measured length of a PEEK capillary tube with a narrow internal diameter may be provided or an adjustable valve may be used which is then fixed at a set position.

According to the preferred embodiment there are three key features of the fixed geometry (including probe design, probe location, source volume, source geometry, exhaust location and gas flows) of the preferred ion source.

Firstly, the preferred atmospheric pressure interface is optimised to effect a compromise in signal intensity across a wide range of input liquid flow rates and a wide range of compounds whilst maintaining sufficient robustness from a small sampling orifice provided in the sample cone 7.

Secondly, the preferred atmospheric pressure interface is optimised to avoid beam instability due to turbulence.

Thirdly, the preferred atmospheric pressure interface is optimised to avoid ionisation suppression effects due to buffer compounds. According to a particularly preferred embodiment the atmospheric pressure interface is optimised to avoid ionisation suppression effects due to ammonia gas and other buffer compounds.

The preferred ion source is preferably arranged to operate with the same liquid flow rates as a conventional ion source as used with a full size mass spectrometer i.e. around 2 mL/min. The ion source according to the preferred embodiment therefore requires gas flow levels and heat which are optimised in order to fully nebulise and desolvate the liquid flow.

It is known from designing conventional ion sources that small ion source volumes are more prone to turbulence and spray instability which leads to an instability in the intensity of the ion beam.

The preferred ion source has a cylindrical source housing which smoothly deflects gas flows around and a source exit located at the bottom of the source housing. An ion source having a cylindrical outer housing has been found to work well and an optimum probe configuration was found for this geometry.

However, during design and testing of a miniature ion source an unexpected problem with the ion source arose which resulted in an adjustment to optimise the probe position and gas flows. It was found that when an ammonia containing buffer (e.g. ammonium formate —$NH_4HCO_2$) was used, gaseous ammonia was formed in the ion source which completely suppressed the ionisation of certain compounds. It will be appreciated that liquid chromatography eluents often contain a compound which includes ammonia.

This led to the probe position and gas flows being altered and subject to experimentation in order to remove this effect. Specifically, the probe was moved to a position lower and closer to the sampling orifice, the nebuliser gas flow was increased and the cone gas flow was set within a specific range i.e. 40-80 L/Hr.

The present invention relates to a combination of geometric parameters and optimum gas flow rates which have been found in combination to provide improved ion efficiency and transmission into the mass spectrometer. The ion source also advantageously does not suffer from deleterious effects due to the formation of gaseous ammonia or other buffer compounds. Departure from the specific geometric parameters and flow rates which are the subject of the present invention has been found to result in poor performance. In particular, operation of the ion source with geometric parameters and flow rates which fall outside of the present invention results either in signal loss or an atmospheric pressure interface which is not sufficiently robust. These problems may also be compounded by signal suppression effects due to the formation of gaseous ammonia or other buffer compounds.

Figure 3:
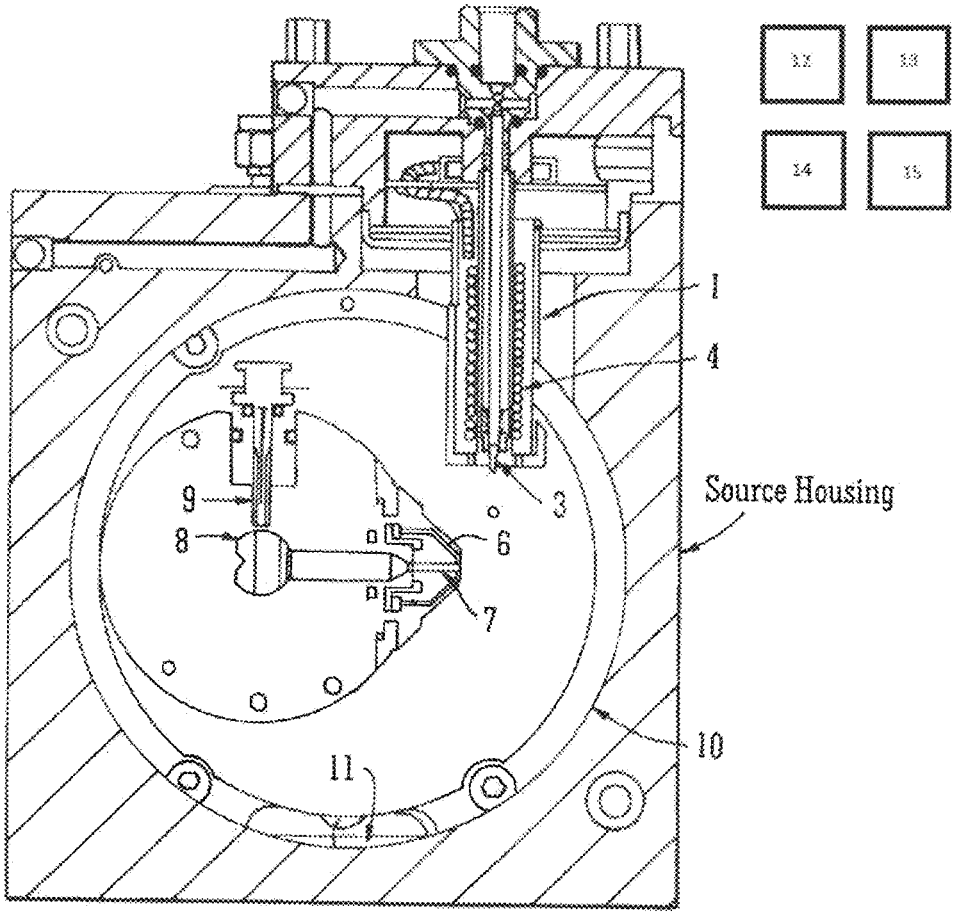
FIG. 3 shows an atmospheric pressure interface for a miniature mass spectrometer according to an embodiment of the present invention.

FIG. 3 shows a preferred embodiment of the present invention showing an Electrospray probe 1 comprising a liquid capillary tube 2 surrounded by a capillary nebuliser tube 3. The capillary tubes 2,3 are surrounded by an annular desolvation heater 4 which is arranged to heat a desolvation gas to a high temperature e.g. up to 650° C.

Ions emitted from the ion source are directed to an atmospheric pressure interface comprising an outer gas cone 6 and an inner sample cone 7 having a gas limiting orifice. The gas cone 6 and inner sample cone 7 are attached to an ion block 8 which is secured to a pumping block or main housing of the mass spectrometer.

A cone gas is preferably supplied to an annular region provided between the inner sample cone 7 and the outer gas cone 6.

According to an embodiment of the present invention the atmospheric pressure interface may further comprise an internal calibration ion source 9 such as an Electron Impact ("EI") or Glow Discharge ("GD") ion source.

As shown in FIG. 3 the ion source may comprise an atmospheric pressure chamber having a cylindrical profile internal wall 10 and a source exhaust 11.

The problem of ionisation suppression effects due to buffer compounds will now be described in more detail.

Figure 4A:
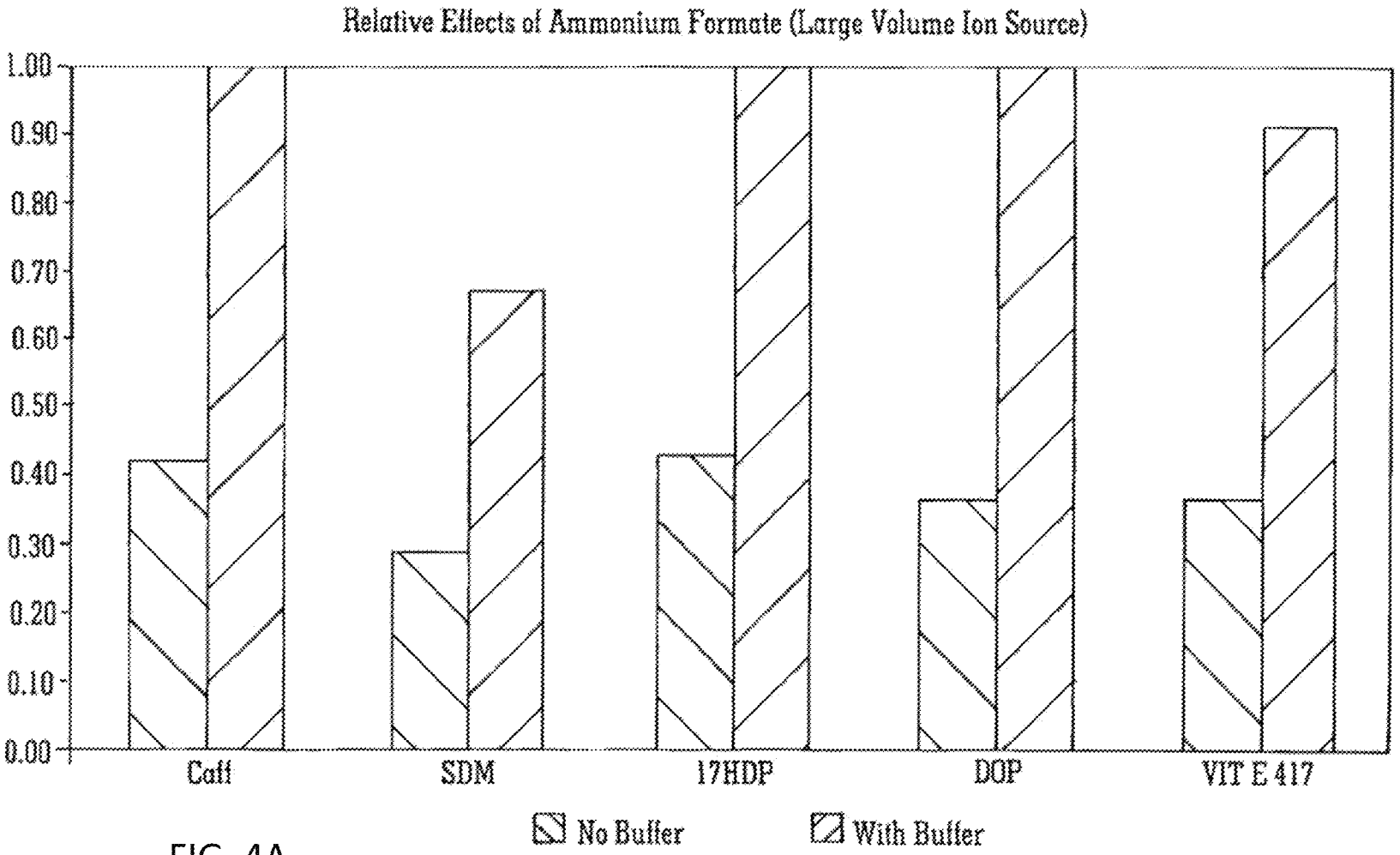
FIG. 4A shows the relative effects of ammonium formate on a large volume ion source and FIG. 4B shows the relative effects of ammonium formate on a small volume ion source.

It is known to add buffers (both volatile and non-volatile) to a sample or to the mobile phase in a liquid chromatography system. The addition of a buffer to the mobile phase can often lead to an improvement in the ionisation efficiency of an Electrospray Ionisation ("ESI") ion source. This is apparent from FIG. 4A which highlights the improvement in signal intensity obtained on a mass spectrometer with a conventional full-size ESI ion source from the addition of ammonium formate buffer at a concentration of 0.01%. The five compounds compared were caffeine ("Caff"), sulfadimethoxine ("SDM"), 17-hydroxyprogesterone ("17HDP"), dioctyl phthalate ("DOP") and Vitamin E ("VIT E 417").

Figure 4B:
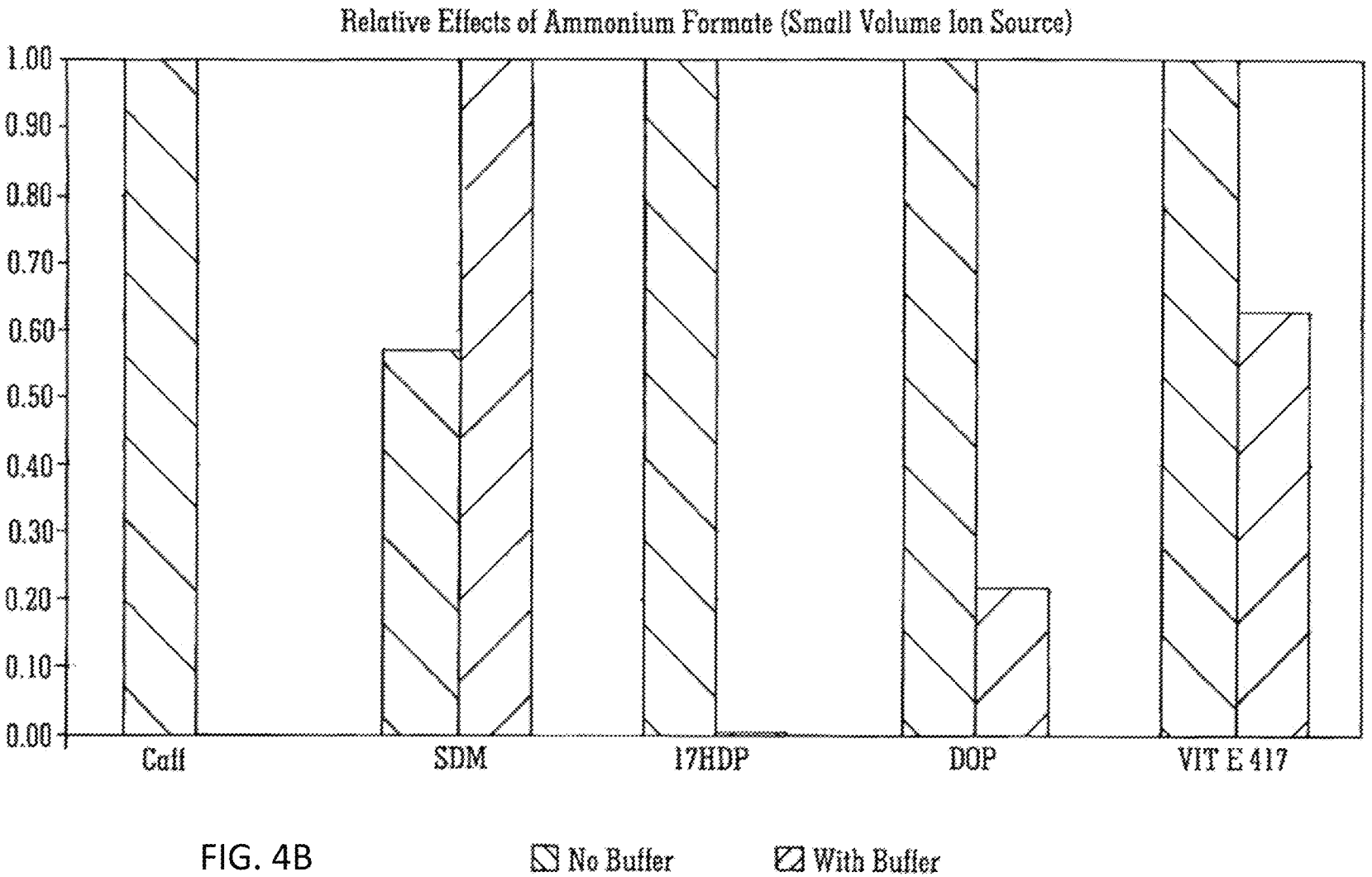

However, it was discovered that in small volume ESI ion sources the behaviour can change quite dramatically. FIG. 4B shows the ratio of the signals obtained with and without ammonium formate buffer on a low volume ion source or miniature mass spectrometer according to a preferred embodiment of the present invention. The signal still improves for SDM when buffer is added but the other four compounds are all suppressed, particularly in the cases of caffeine and 17HDP where there is little or no signal from the compounds at all.

This gross signal suppression could be recreated by admitting small quantities of gaseous ammonia into the ion source whilst monitoring the mass spectral response to a sample containing no buffer. This suggested that the presence of gaseous ammonia released from the buffered sample inside the ion source was the cause of the signal suppression. The lack of suppression in the large volume ion source could potentially be due to the natural dilution that a larger volume provides and/or different gas flow dynamics, gas velocity etc. in a source of smaller volume.

Figure 5:
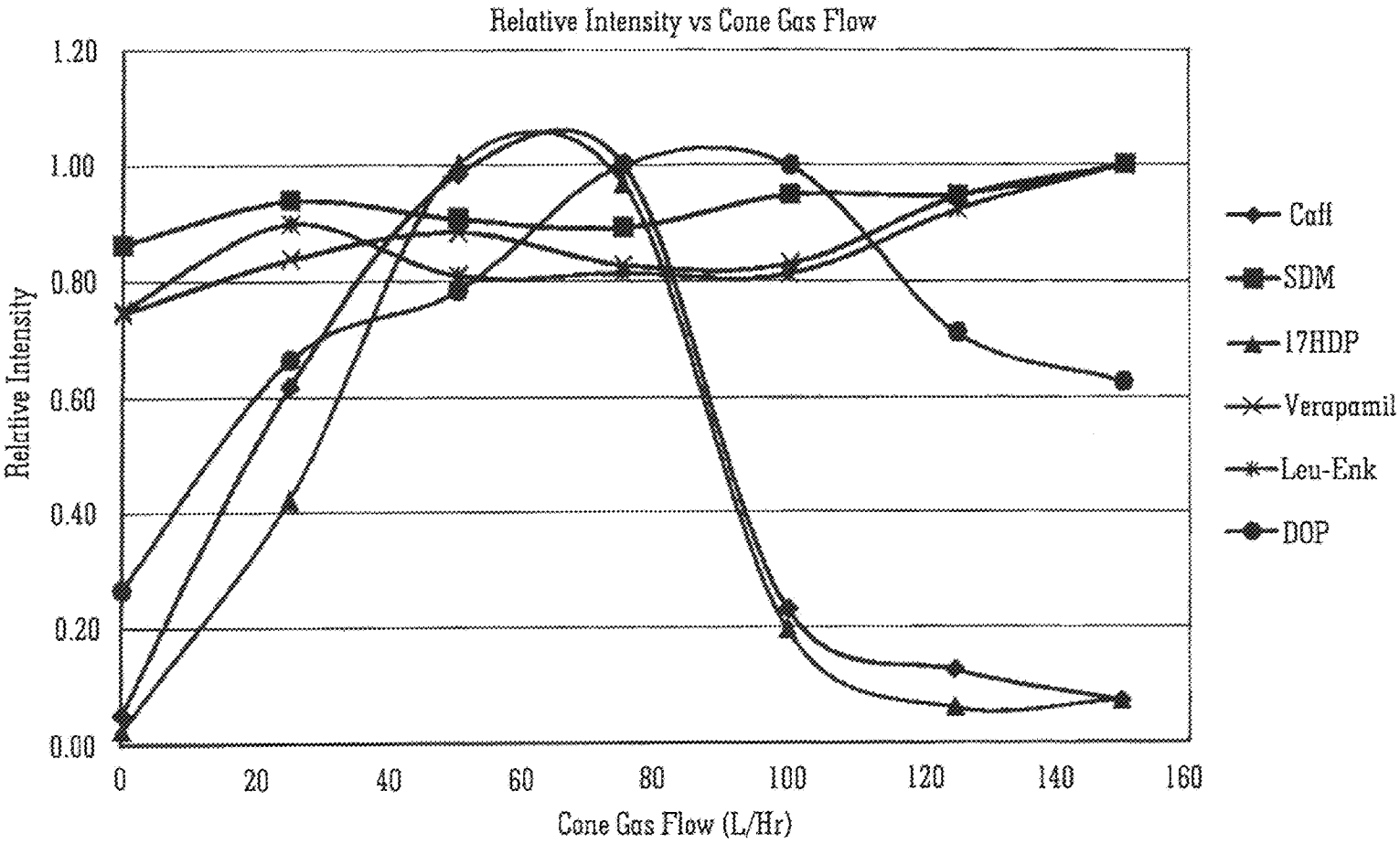
FIG. 5 shows a graph of relative intensity versus cone gas flow illustrating a preferred cone gas flow rate.

It was discovered and is an important aspect of the preferred embodiment of the present invention that the gross suppression could be counteracted through a combination of multiple gas flows within the small volume ion source. For example, one of the gas flows which was found to be important was the cone gas flow rate as can be seen from FIG. 5. FIG. 5 shows the mass spectral response for six compounds, namely the four compounds referred to above together with verapamil and Leu-enkephalin ("Leu Enk") and is plotted as a function of the cone gas flow rate. SDM, verapamil and Leu-Enk were largely unaffected by the cone gas flow rate. However, caffeine and 17HDP were highly suppressed at zero to low cone gas flows as well as at higher cone gas flows.

It is apparent, therefore, that there is an optimum cone gas flow rate of 40-80 L/hr for the preferred geometry.

Figure 6:
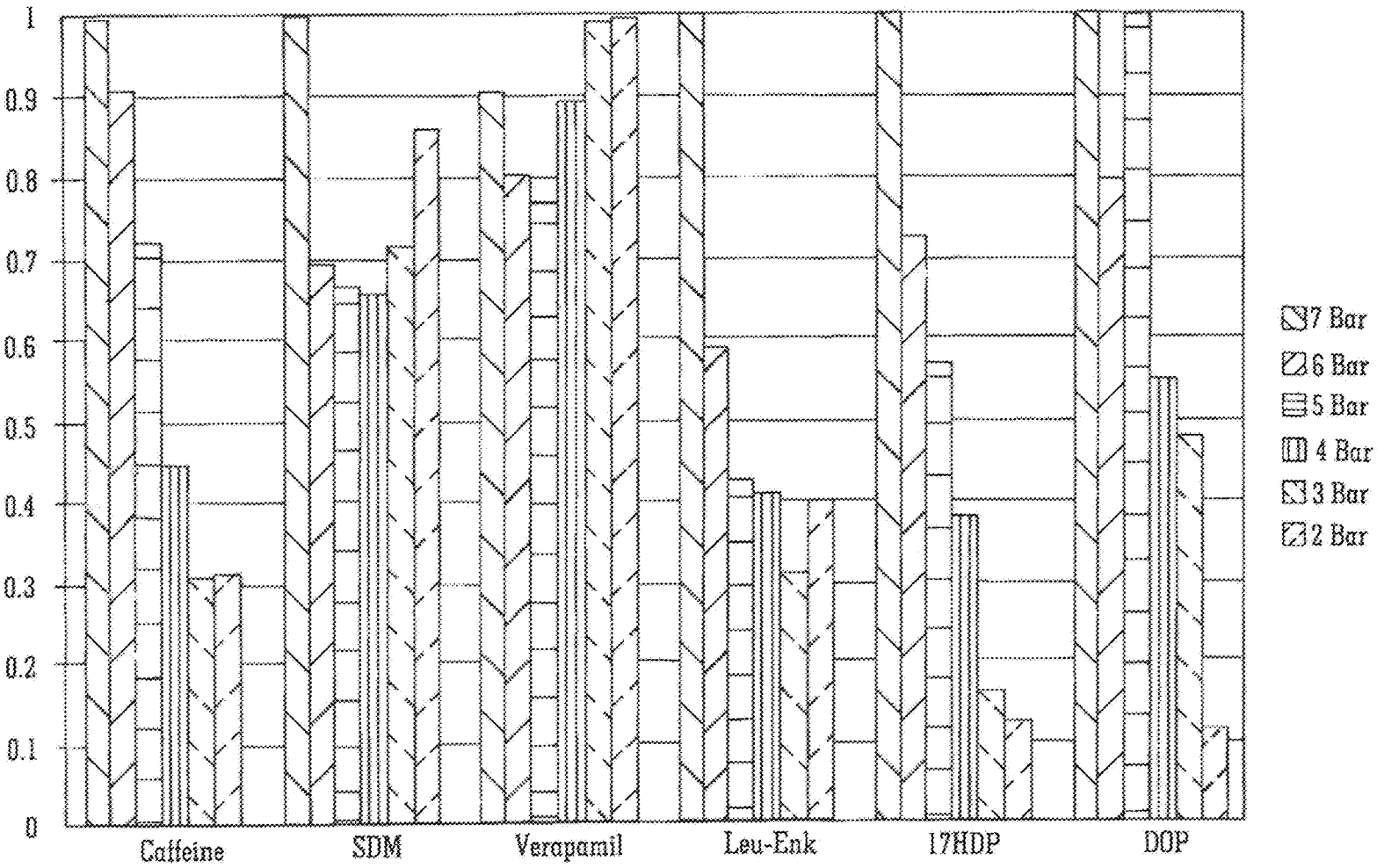
FIG. 6 shows the ratio of no-buffer to buffer signal as plotted for different nebuliser gas flows.

Similarly, the nebulizer gas flow was found to play an important role in the avoidance of buffer suppression effects as can be seen in FIG. 6. FIG. 6 shows the ratio of no-buffer to buffer signal as plotted for different nebuliser gas flows. The gas flow was altered in this case by changing the regulation pressure on the gas supply providing a nitrogen nebuliser gas with higher pressures resulting in higher nebuliser gas flows. SDM and verapamil again show no gross change in the signal suppression with varying nebuliser gas flow. However, 17HDP and DOP show a large drop in intensity at low nebuliser gas flows when buffer is present.

Figure 7A:
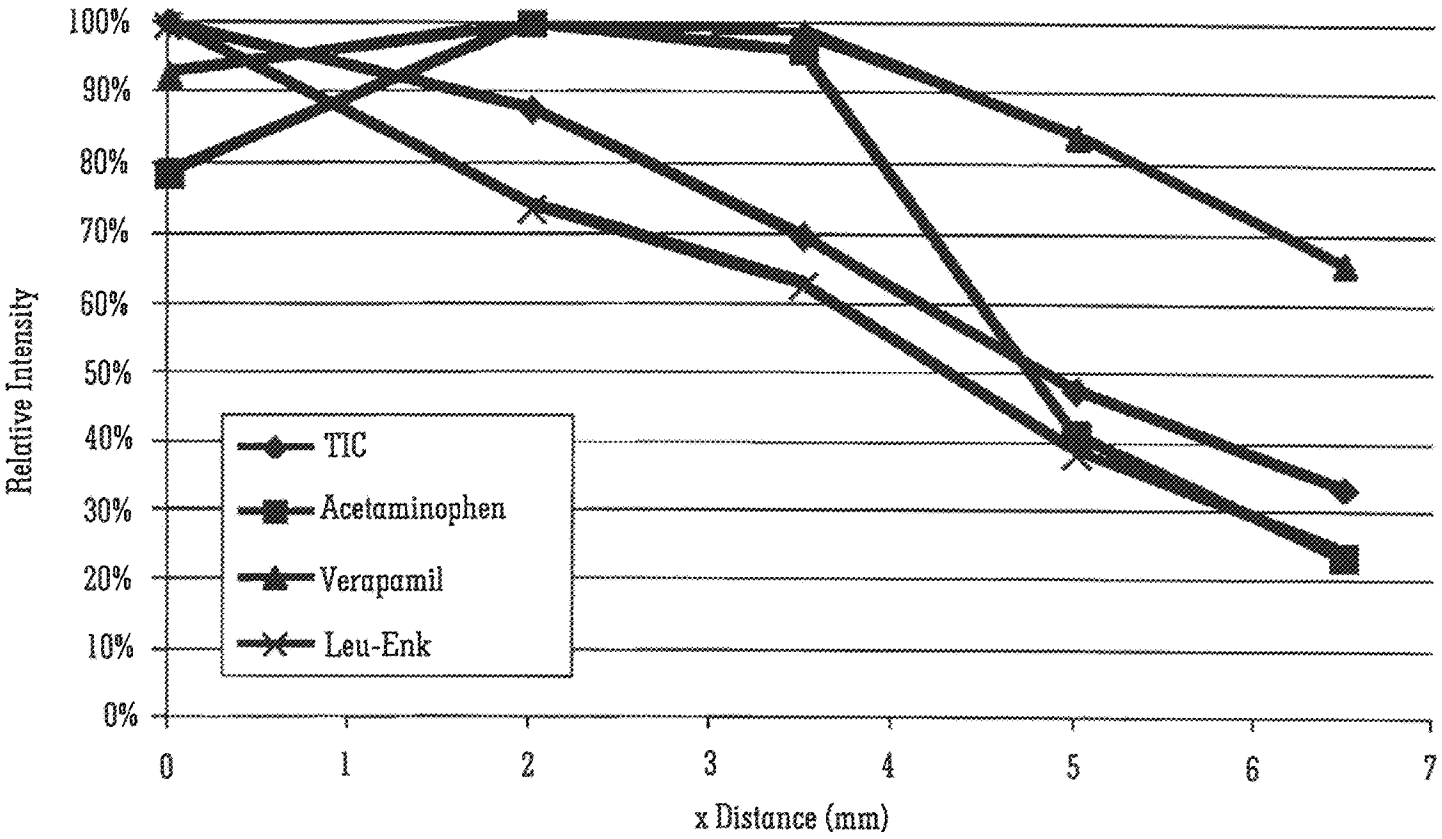
FIG. 7A shows the relation between relative sensitivity and the displacement of the Electrospray probe in the x-direction and FIG. 7B shows the relative total ion current relative to the displacement of the Electrospray probe in the x-direction which was observed when the high voltage to the Electrospray probe was turned OFF.

FIG. 7A shows the relative sensitivity observed when the Electrospray Ionisation ("ESI") probe was positioned at different distances away from the sampling orifice in the x direction. Data is shown in FIG. 7A for three individual compounds as well as the total ion count ("TIC"). It is apparent from FIG. 7A that the signal maxima occur at either 0 or 2 mm and that the signal then declines as the probe is moved further away.

Figure 7B:
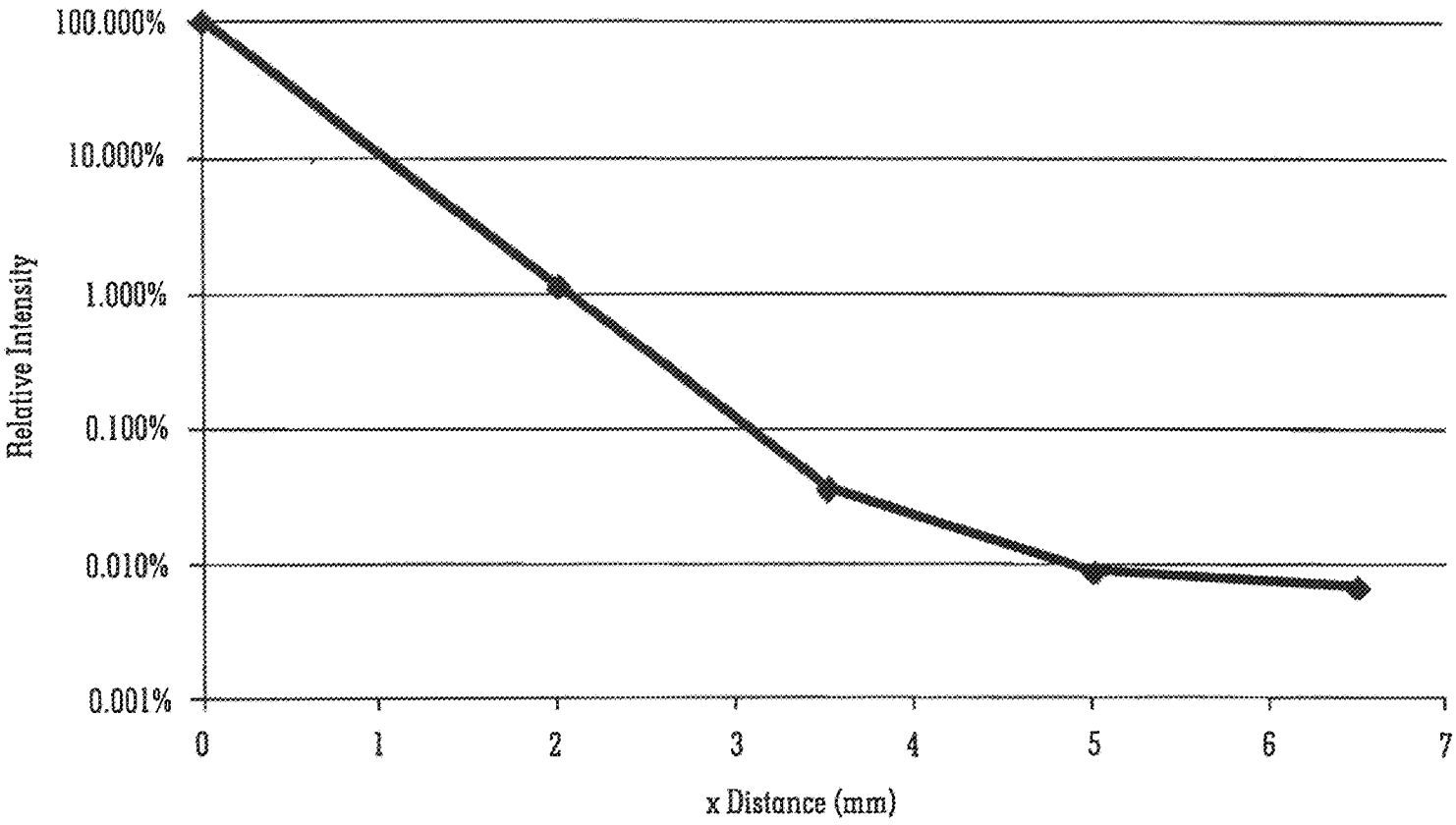

FIG. 7B shows the relative TIC which was observed when the high voltage to the ESI probe was turned OFF. The observation of a strong ion signal when the probe is positioned close to the sampling aperture (e.g. x=0 mm) is due to the nebulised spray from the probe directly impinging onto surfaces in and around the sampling aperture and as a result producing secondary ionisation due to the impact. Such an arrangement is disadvantageous since a probe operating in a position where unevaporated droplets strike the sampling orifice will have a negative effect on the long term operation and sensitivity of the mass spectrometer especially due to the build up of material/residue leading to surface charging of electrodes or through physical blocking/occlusion of the sampling orifice itself.

It has been found, therefore, that the optimum position for the probe is therefore a compromise between maximising the signal intensity (e.g. by ensuring that $x \leq 5.0$ mm) whilst minimising the amount of spray directly impinging near the sampling orifice (e.g. by ensuring that $x \geq 2.0$ mm).

Although the present invention has been described with reference to preferred embodiments, it will be understood by those skilled in the art that various changes in form and detail may be made without departing from the scope of the invention as set forth in the accompanying claims.

The invention claimed is:

1. A mass spectrometer comprising:

an atmospheric pressure interface comprising a gas cone having an inlet aperture, wherein said gas cone has a first longitudinal axis arranged along an x-axis;

an Electrospray ion source comprising a first capillary tube having an outlet and having a second longitudinal axis and a second capillary tube which surrounds said first capillary tube;

a desolvation gas supply tube;

an analyte liquid supply arranged and adapted to supply an analyte liquid via said first capillary tube so that said liquid exits said outlet of said first capillary tube; and a nebuliser gas supply arranged and adapted to supply a nebuliser gas via said second capillary tube;

wherein an outlet of said first capillary tube is arranged at a distance x mm along said x-axis as measured from the centre of said gas cone inlet aperture, a distance y mm along a y-axis as measured from the centre of said gas cone inlet aperture and a distance z mm along a z-axis as measured from the centre of said gas cone inlet aperture;

wherein said x-axis, said y-axis and said z-axis are mutually orthogonal;

wherein:

said desolvation gas supply tube surrounds said second capillary tube; and wherein said mass spectrometer further comprises:

a desolvation gas supply arranged and adapted to supply a desolvation gas via said desolvation gas supply tube;

a heater arranged and adapted to heat said desolvation gas; and a cone gas supply arranged and adapted to supply a cone gas to said gas cone;

wherein an orientation of said Electrospray ion source relative to said atmospheric pressure interface is permanently fixed;

wherein the ratio z/x is in a range 1-5:1; and wherein said nebulizer gas supply supplies said nebulizer gas via said second capillary tube at a flow rate in a range 80-150 L/hr.

2. A mass spectrometer as claimed in claim 1, wherein x is in a range 2.0-5.0 mm.

3. A mass spectrometer as claimed in claim 1, wherein y falls within a range selected from the group consisting of: (i) 0.0-1.0 mm; (ii) 1.0-2.0 mm; (iii) 2.0-3.0 mm; (iv) 3.0-4.0 mm; and (v) 4.0-5.0 mm.

4. A mass spectrometer as claimed in claim 1, wherein z falls within a range selected from the group consisting of: (i) 5-6 mm; (ii) 6-7 mm; (iii) 7-8 mm; (iv) 8-9 mm; (v) 9-10 mm; (vi) 10-11 mm; (vii) 11-12 mm; (viii) 12-13 mm; (ix) 13-14 mm; (x) 14-15 mm; (xi) 15-16 mm; (xii) 16-17 mm; (xiii) 17-18 mm; (xiv) 18-19 mm; (xv) 19-20 mm; (xvi) 20-21 mm; (xvii) 21-22 mm; (xviii) 22-23 mm; (xix) 23-24 mm; and (xx) 24-25 mm.

5. A mass spectrometer as claimed in claim 1, wherein:

said first capillary tube protrudes from said second capillary tube by 0.5 mm±0.2 mm; and/or said first capillary tube protrudes from said desolvation gas supply tube by 1.2 mm±0.2 mm.

6. A mass spectrometer as claimed in claim 1, wherein said second axis is arranged at an angle $\alpha$ relative to said z-axis, wherein $\alpha$ falls within a range selected from the group consisting of: (i) 0-1°; (ii) 1-2°; (iii) 2-3°; (iv) 3-4°; (v) 4-5°; (vi) 5-6°; (vii) 6-7°; (viii) 7-8°; (ix) 8-9°; (x) 9-10°; (xi) 10-11°; (xii) 11-12°; (xiii) 12-13°; (xiv) 13-14°; and (xv) 14-15°.

7. A mass spectrometer as claimed in claim 1, wherein said second axis is arranged at an angle $\beta$ relative to said y-axis, wherein $\beta$ falls within a range selected from the group consisting of: (i) 0-1°; (ii) 1-2°; (iii) 2-3°; (iv) 3-4°; (v) 4-5°; (vi) 5-6°; (vii) 6-7°; (viii) 7-8°; (ix) 8-9°; (x) 9-10°; (xi) 10-11°; (xii) 11-12°; (xiii) 12-13°; (xiv) 13-14°; and (xv) 14-15°.

8. A mass spectrometer as claimed in claim 1, wherein said second axis is arranged at an angle $\gamma$ relative to said y-axis, wherein $\gamma$ falls within a range selected from the group consisting of: (i) 0-1°; (ii) 1-2°; (iii) 2-3°; (iv) 3-4°; (v) 4-5°; (vi) 5-6°; (vii) 6-7°; (viii) 7-8°; (ix) 8-9°; (x) 9-10°; (xi) 10-11°; (xii) 11-12°; (xiii) 12-13°; (xiv) 13-14°; and (xv) 14-15°.

9. A mass spectrometer as claimed in claim 1, wherein said analyte liquid supply is arranged and adapted to supply said analyte liquid via said first capillary tube so that said liquid exits said outlet of said first capillary tube at a flow rate that is fixed such that a user cannot adjust the flow rate.

10. A mass spectrometer as claimed in claim 1, wherein said analyte liquid supply is arranged and adapted to supply said analyte liquid via said first capillary tube so that said liquid exits said outlet of said first capillary tube at a flow rate >200 μL/min.

11. A mass spectrometer as claimed in claim 1, wherein said nebuliser gas supply is arranged and adapted to supply said nebuliser gas via said second capillary tube at a flow rate that is fixed such that a user cannot adjust the flow rate.

12. A mass spectrometer as claimed in claim 1, wherein said desolvation gas supply is arranged and adapted to supply said desolvation gas via said desolvation gas supply tube at a flow rate that is fixed such that a user cannot adjust the flow rate.

13. A mass spectrometer as claimed in claim 1, wherein said desolvation gas supply is arranged and adapted to supply said desolvation gas via said desolvation gas supply tube at a flow rate in a range 400-1200 L/hr.

14. A mass spectrometer as claimed in claim 1, wherein said heater is arranged and adapted to heat said desolvation gas to a temperature ≥100° C.

15. A mass spectrometer as claimed in claim 1, wherein said cone gas supply is arranged and adapted to supply said cone gas to said gas cone at a flow rate that is fixed such that a user cannot adjust the flow rate.

16. A mass spectrometer as claimed in claim 1, wherein said cone gas supply is arranged and adapted to supply said cone gas to said gas cone at a flow rate in a range 40-80 L/hr.

17. A method of mass spectrometry comprising:

providing an atmospheric pressure interface comprising a gas cone having an inlet aperture, wherein said gas cone has a first longitudinal axis arranged along an x-axis;

providing an Electrospray ion source comprising a first capillary tube having an outlet and having a second longitudinal axis and a second capillary tube which surrounds said first capillary tube;

supplying an analyte liquid via said first capillary tube so that said liquid exits said outlet of said first capillary tube; and supplying a nebuliser gas via said second capillary tube;

wherein an outlet of said first capillary tube is arranged at a distance x mm along said x-axis as measured from the centre of said gas cone inlet aperture, a distance y mm along a y-axis as measured from the centre of said gas cone inlet aperture and a distance z mm along a z-axis as measured from the centre of said gas cone inlet aperture; and wherein said x-axis, said y-axis and said z-axis are mutually orthogonal;

wherein said method further comprises:

providing a desolvation gas supply tube which surrounds said second capillary tube;

supplying a desolvation gas via said desolvation gas supply tube;

heating said desolvation gas; and supplying a cone gas to said gas cone;

wherein an orientation of said Electrospray ion source relative to said atmospheric pressure interface is permanently fixed:

wherein the ratio z/x is in range 1-5:1; and wherein said nebulizer gas supply supplies said nebulizer gas via second capillary tube at a flow rate in a range 80-150 L/hr.

* * * * *